United States Patent [19]

Ingram

[11] 4,381,569

[45] May 3, 1983

[54] ADJUSTABLE DRAIN PLUG

[76] Inventor: J. Richard Ingram, 1084 Village Rd., Stone Mountain, Ga. 30088

[21] Appl. No.: 292,677

[22] Filed: Aug. 13, 1981

[51] Int. Cl.[3] ..... A47K 1/14

[52] U.S. Cl. ..... 4/295; 4/286; 4/287; 4/204; 4/194; 138/89

[58] Field of Search ..... 4/287, 295, 204, 205, 4/286, 288, 194; 138/89; 251/263

[56] References Cited

U.S. PATENT DOCUMENTS

| | | | |
|---|---|---|---|
| 729,360 | 5/1903 | Kosiol | 4/204 |
| 1,071,627 | 8/1913 | Roenstierna | 4/295 |
| 2,773,619 | 12/1956 | Moeller | 4/295 X |
| 2,915,762 | 12/1959 | Kivela | 4/295 |
| 3,314,086 | 4/1967 | Minella | 4/204 X |
| 3,315,279 | 4/1967 | Nolan | 4/204 X |
| 3,366,980 | 2/1968 | Petursson et al. | 4/295 |
| 3,468,512 | 9/1969 | Politz | 4/295 X |
| 3,771,177 | 11/1973 | Roger et al. | 4/287 |
| 3,949,433 | 4/1976 | Liou | 4/295 |
| 4,276,662 | 7/1981 | Young | 4/287 |

*Primary Examiner*—Henry K. Artis
*Attorney, Agent, or Firm*—Patrick F. Henry

[57] ABSTRACT

An adjustable drain plug for use in sinks and lavatories especially to replace a previous drain plug which is either lost or broken. The drain plug comprises an elongated, flexible plastic or rubber stopper which removably fits into the hole in the drain and has a flanged top covered by a rigid top cover of metal or plastic. An elongated drain member is preferably constructed in a sleeve formation in two sections and receiving a threaded stud attached to the head and also adjustably threaded into the top of the member with a lock nut thereon. The two sections are adjustable being connected by a threaded stud and there is an adjustable foot on the bottom of the member either in the form of a flat disc or a hook. Alternatively, the stopper may be formed in four tapered sections which may be screwed down and over the top of the member.

9 Claims, 5 Drawing Figures

ADJUSTABLE DRAIN PLUG

BACKGROUND OF THE INVENTION

1. FIELD OF THE INVENTION

Plumbing fixtures and devices and particularly drain plugs or "Pop-up" wastes for sinks and lavatories, especially those which are operated by an external control comprising a means for lifting and lowering the plug in the hole of the sink or lavatory.

2. DISCUSSION OF PREVIOUS DRAIN PLUG ARRANGEMENTS

Stoppers and drain plugs, or "Pop-up" wastes, are quite well known in the art for many years. One common arrangement provides a drain plug with a gasket on a head which is attached to an elongated structure that extends down into the drain pipe and is operated by a concealed control rod which is actuated externally on the sink or lavatory by a control button, left rod, lever or handle manipulated by hand. Sometimes these devices are lost or misplaced (as for example accidentally thrown in the trash), sometimes such devices are broken or become worn beyond use or for other reasons it becomes necessary to replace the entire arrangement. This presents a problem if the particular style and model and arrangement of sink or lavatory "Pop-up" waste is no longer in production and a replacement cannot be located. Most of the devices are specially designed to fit only the particular lavatory "Pop-up" waste and are not adaptable or adjustable for use in other sinks or lavatory "Pop-up" wastes. There is therefore a need for a replacement drain plug arrangement which can be adjusted so as to fit most any existing sink or lavatory "Pop-up" waste and such a device of course could be purchased and utilized in new installations as sort of a universal drain plug. The present drain plug arrangement will fit most, if not all, existing sinks and lavatory "Pop-up" wastes, either the control or noncontrol type and can be used to substitute and replace the original drain plug. There are various adjustments in the present drain plug arrangement which make it simple and expedient for this purpose and it is almost a universal replacement.

SUMMARY OF THE INVENTION

A drain plug comprising a stopper adjustably attached to an elongated drain member which is adjustable in length and has an optional adjustable foot thereon.

An object of this invention is to provide a drain plug member which will fit most sinks and lavatories "Pop-up" wastes and is adjustable for this purpose.

Still another object of this invention is to provide such an arrangement which includes an elongated drain member that may be made in two pieces adjustably joined to vary the length and adjustably attached to the plug.

An additional object of this invention is found in the manner in which the drain plug is adjustably attached to the top of the elongated member which extends down into the drain pipe so that adjustment may be made including inserting the top of the member into the bottom of the plug.

Other and further objects and advantages of this invention will become apparent upon reading the following specification of the preferred embodiment taken in conjunction with the accompanying drawings.

DESCRIPTION OF THE PREFERRED EMBODIMENT

Figure 1:
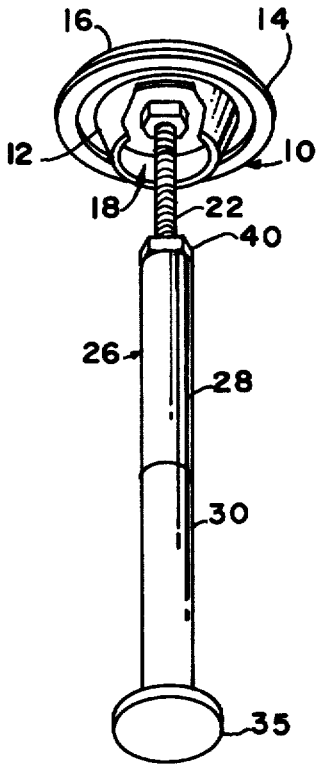
FIG. 1 is a perspective view of a preferred form of the present invention.
Figure 2:
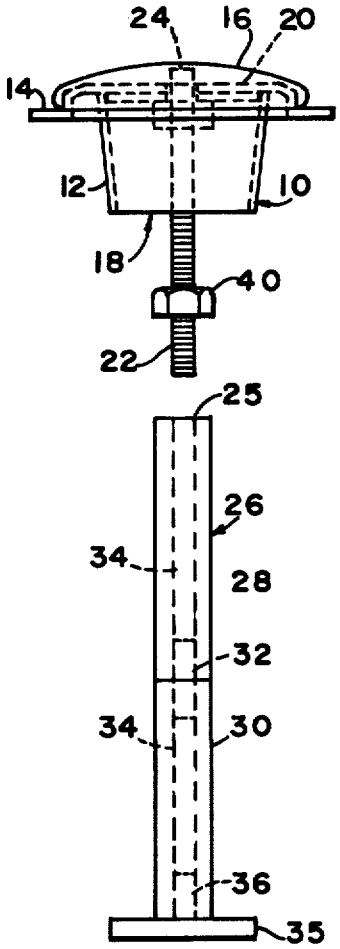
FIG. 2 is a side elevation view of the device shown in FIG. 1 with some components disassembled.
Figure 3:
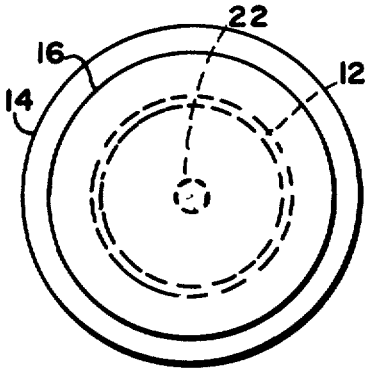
FIG. 3 is a top plan view looking down on the device shown in FIGS. 1 and 2.

In FIG. 1 the drain plug 10 comprises a tapered stopper 12 which may be molded from rubber, plastic or the like including a circular, peripheral gasket 14 which is a circular flange that is normally forced by the weight of the water and the weight of the drain plug 10 to seal a conventional drain opening found in a conventional sink or lavatory including the types which have concealed or internal control mechanisms operated by external control handles or buttons. The top of gasket 14 is covered by a cover 16 which may be manufactured from decorative metal, plastic or the like. Cover 16 is preferably rigid and forms a smooth protective surface over the top of the resilient gasket 14. Stopper 12 has an internal opening 18 therein leading to the top surface 20 of the stopper 12 which is beneath cover 16.

A threaded member such as a rod, shaft or stud 22 has one end 24 threaded and locked into the bottom 20 and extending substantially centrally, medially through the stopper 12 and out of the opening 18. Rod 22 threadedly engages the internally threaded portion of the top 25 of an elongated drain member 26 comprising top section 28 and bottom section 30 adjustably connected and attached together by means of a threaded stud 32 threadedly engaging the internal threaded bore 34 of each of the top sections 28 and bottom section 30.

A small adjustable foot member 35 is shaped like a disc and is threadedly attached to the bottom end of bottom section 30 by a threaded stud 36.

In the operation of the device shown in FIG. 1, the top and bottom sections 28, 30 are adjusted on the respective rods 22, 32 to fit the length of the drain pipe opening and if necessary the bottom section 30 may be removed and discarded and the bottom foot 35 may be removed and screwed into the bottom of top section 28 so as to achieve the correct length and to place the control rod within operating distance beneath the bottom foot 35. This is a simple procedure which may be accomplished by visual inspection and one or two trial attempts to select and adjust the drain plug 10 to fit the opening. If necessary, the top of top section 28 may be adjusted all the way up into the interior of the stopper 12 through the opening 18 and is locked in place at any given time by means of a set nut 40 on the threaded shaft 22.

Furthermore, if desired in the manufacture of the item, the top section 28 may be made longer or shorter than the bottom section 30 thereby providing even more selectively and adjustment to the device so that one or the other of the sections 28, 30 may be removed and discarded or both may be used together and adjusted lengthwise to fit the drain pipe.

All threaded members and nuts or the like (e.g. rod 22 or nut 40) may have a thread-locking compound applied thereto to prevent dislodgement or disengagement.

Figure 4:
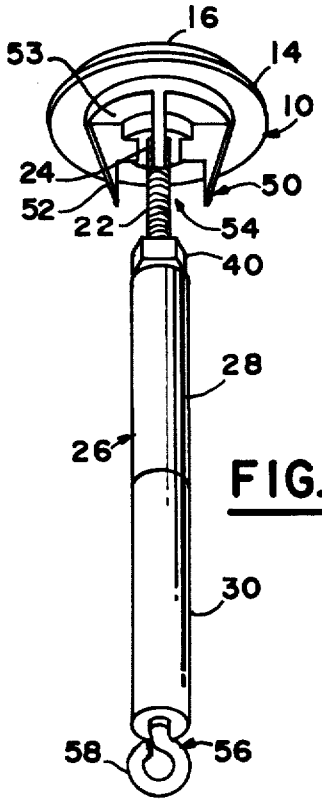
FIG. 4 is a perspective view of a second, alternative form of the present invention having a different plug arrangement and a different lower end.
Figure 5:
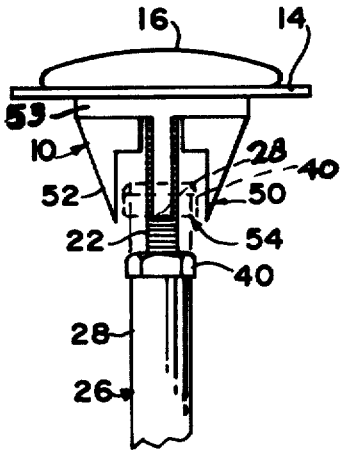
FIG. 5 is a side elevation view of the device shown in FIG. 4.

In the modified form shown in FIGS. 4 and 5, rather than the solid tapered, cup-like formation of stopper 12, the stopper 50 may be fabricated by molding or cutting into several different tapered sections or plates 52 of identical construction each attached to a common top flat head 53 and each being notched or cut away on the interior to receive the threaded stud 22 therethrough and to provide a three-dimensional space or opening 54 to receive the upper stud 22 of the top section 28. Nut 40 may be rotated on stud 22 into the opening 54 so that the upper end of section 28 will adjust upwardly into the opening 54 to shorten the overall length as shown by dotted lines in FIG. 5.

The foot 35 in the FIG. 1 version has been replaced by another foot 56 which is a hook having a curved portion 58 leading to a terminal end. The portion 58 may be bent almost 360 degrees to form a closed eye rather than an open hook.

While I have shown and described a particular embodiment of my invention together with a suggested alternative form, this is by way of illustration and doest not constitute any sort of limitation on the scope of the invention in which various alterations, changes, deviations, omissions, additions and departures may be made without avoiding the scope of the invention as defined only by a proper interpretation of the appended claims.

I claim:

1. In a drain plug to be used in a sink, lavatory or the like which includes a drain opening and a drain pipe therein, sometimes called a "Pop-up" drain, and which may also include a conventional control member for actuating the drain plug:

a drain stopper constructed from plastic, rubber or other similar material and having an open interior, said stopper having a gasket thereon comprising a peripheral flange extending outwardly from said stopper, a cover over said gasket, a threaded member having one end attached to the bottom of said cover and extending outwardly from said stopper, a drain member threadedly engaging the other end of said threaded member and being threadedly mounted thereon for adjustment toward or away from said cover including adjustment into the open part of said stopper.

2. The device claimed in claim 1 wherein said drain member comprises two sections and adjustable means between said sections whereby said drain member may be lengthened or shortened selectively.

3. The device claimed in claim 2 wherein there is a removable and adjustable foot on the bottom of said drain member.

4. The device claimed in claim 2 wherein said drain member sections are connected by a threaded adjustment shaft having opposed ends threadedly engaging an internal threaded portion of a respective section.

5. The device claimed in claim 3 wherein said foot is a flat disc member.

6. The device claimed in claim 3 wherein said foot is a foot member curved to form a space.

7. The device in claim 6 wherein said foot member forms an eye.

8. The device claimed in claim 1 wherein said stopper comprises individual, separate sections spaced from each other and depending from a common head on said stopper, said sections defining a bottom opening to receive the drain member therein for adjustment.

9. The device claimed in claim 8 wherein each of said sections is a tapered plate defining with said other tapered plates the space into which the top of said drain member may be adjusted.

* * * * *